US009169648B1

(12) United States Patent
Mills

(10) Patent No.: US 9,169,648 B1
(45) Date of Patent: Oct. 27, 2015

(54) MONOLITHIC SPIRAL DESIGN ROOF PIPE FLASHING

(71) Applicant: Robert Mills, Springfield, TN (US)

(72) Inventor: Robert Mills, Springfield, TN (US)

( * ) Notice: Subject to any disclaimer, the term of this patent is extended or adjusted under 35 U.S.C. 154(b) by 0 days.

(21) Appl. No.: 14/662,950

(22) Filed: Mar. 19, 2015

(51) Int. Cl.
*E04D 13/147* (2006.01)

(52) U.S. Cl.
CPC ..... *E04D 13/1476* (2013.01); *E04D 13/147* (2013.01)

(58) Field of Classification Search
CPC ..... E04D 13/1476
See application file for complete search history.

(56) References Cited

U.S. PATENT DOCUMENTS

| | | | | | |
|---|---|---|---|---|---|
| 1,103,666 | A * | 7/1914 | Fife | 285/13 | |
| 1,587,250 | A * | 6/1926 | Stephenson | 285/44 | |
| 1,594,932 | A * | 8/1926 | Doyle | 285/43 | |
| 1,678,715 | A * | 7/1928 | Stephenson | 285/44 | |
| 4,120,129 | A * | 10/1978 | Nagler | E04D 13/1407 | 285/4 |
| 4,211,423 | A * | 7/1980 | Resech | E04D 13/1407 | 277/636 |
| 4,768,812 | A | 9/1988 | Katz | | |
| 5,010,700 | A | 4/1991 | Blair | | |
| 5,176,408 | A | 1/1993 | Pedersen | | |
| D364,933 | S * | 12/1995 | Schalle | D25/199 | |
| 6,110,311 | A * | 8/2000 | Mayle et al. | 156/189 | |
| 6,513,291 | B2 * | 2/2003 | Gilsdorf | 52/297 | |
| 6,588,801 | B1 * | 7/2003 | Mayle | 285/42 | |
| 6,601,351 | B1 * | 8/2003 | Zerfoss | 52/198 | |
| 6,691,473 | B1 * | 2/2004 | Mayle et al. | 52/198 | |
| 6,892,499 | B1 * | 5/2005 | Mayle | 52/219 | |
| 7,526,895 | B2 * | 5/2009 | Edgar | E04D 13/1476 | 454/365 |
| 7,770,335 | B2 * | 8/2010 | Evensen | 52/60 | |
| 8,291,658 | B1 * | 10/2012 | Johnston | E04D 13/1471 | 285/42 |
| 8,656,667 | B2 * | 2/2014 | Beall | 52/219 | |
| 2005/0028456 | A1 * | 2/2005 | McLane | E04D 13/1407 | 52/58 |
| 2005/0150176 | A1 * | 7/2005 | Erekson | 52/58 | |
| 2006/0130411 | A1 * | 6/2006 | Edgar | E04D 13/1476 | 52/58 |
| 2007/0101664 | A1 * | 5/2007 | Hoy et al. | 52/198 | |
| 2010/0109318 | A1 * | 5/2010 | Mulligan | 285/42 | |
| 2011/0094165 | A1 * | 4/2011 | McDow et al. | 52/58 | |
| 2011/0203201 | A1 * | 8/2011 | Lechuga | 52/220.1 | |
| 2012/0126529 | A1 * | 5/2012 | Beall | 285/42 | |
| 2013/0328300 | A1 * | 12/2013 | Bond | 285/42 | |
| 2014/0159359 | A1 * | 6/2014 | Beall | 285/42 | |

* cited by examiner

*Primary Examiner* — Rodney Mintz
(74) *Attorney, Agent, or Firm* — Crossley Patent Law

(57) ABSTRACT

A monolithic spiral design roof pipe flashing having a spiraled base. A spiraled boot is continuously disposed upon the base. The boot defines an inner recess and has annular upper lip defining a spiral conduit. The upper lip further has an angular rim. The base, the boot, and the upper lip are monolithically formed of a molded elastomeric hydrophobic polymer substance and are configured to flex from a closed spiral configuration to an open spiral configuration to create a gap between an exterior surface and an interior surface proximal a shared continuous outer edge of the base, the boot, and the upper lip through which the roof pipe is inserted and fitted within the conduit. Upon release of the flex, the gap closes with the pipe being disposed within the conduit and with an overlap of the exterior and interior surfaces for water tight and flush contact therebetween.

4 Claims, 5 Drawing Sheets

MONOLITHIC SPIRAL DESIGN ROOF PIPE FLASHING

BACKGROUND OF THE INVENTION

Various types roof pipe flashing devices are known in the prior art. However, many of these devices are cumbersome to install. This is attributed to the multiple components of these prior art devices or the absence of a spiral design that allows the device to flex around a pipe. Instead, the prior art devices require a user to fit the pipe flashing over a bottom end of the pipe, placing a terminal portion of the pipe within a conduit, and sliding the flashing down the pipe into proper position. Alone, this is more hassle than necessary, however it is often made more cumbersome when there are various pipe attachments fitted to the bottom end of the pipe. When pipe attachments are present, the user must first remove the attachments before he is able to fit the pipe flashing over the bottom end of the pipe. These same attachments must be removed every time the pipe flashing becomes weathered or worn and needs to be replaced.

Thus, what is needed is monolithic spiral design roof pipe flashing having a monolithic hydrophobic spiraled design including a base, a boot defining an inner recess, an annular upper lip defining a conduit, wherein the device is configured to flex from an open spiral configuration to a closed spiral configuration. Applicant's device allows a user to adapt roof pipe flashing to a pipe, without having to remove attachments at the bottom end of the pipe, simply by flexing the device from a closed spiral configuration to an open spiral configuration, and fitting the pipe within a gap created by the flexing. Thus, the user can replace weathered or worn roof pipe flashing, or add new roof pipe flashing without having to remove any attached impediments disposed at the bottom end of the pipe.

FIELD OF THE INVENTION

The present invention relates to roof pipe flashing, and more particularly, to a monolithic hydrophobic spiral design roof pipe flashing.

SUMMARY OF THE INVENTION

The general purpose of the present monolithic spiral design roof pipe flashing, described subsequently in greater detail, is to provide a monolithic spiral design roof pipe flashing which has many novel features that result in a monolithic spiral design roof pipe flashing which is not anticipated, rendered obvious, suggested, or even implied by prior art, either alone or in combination thereof.

The monolithic spiral design roof pipe flashing includes a spiraled base. The preferred embodiment of the base is a flattened square shape having a front side spaced apart from a rear side, a left side spaced apart from a right side, a top surface, and a bottom surface. The flattened spiraled base serves as flashing around the base of a roof piping. The flattened shape of the base, in conjunction with the angle of a roof allows precipitation accumulated on the base to bead off of the base and down the roof. The base can be fitted to above a plurality of roof shingles or other features, at a user's preferred direction of roof precipitation. Other shapes for the base are envisioned that would not depart from the spirit and scope of this invention.

The device further includes a frustoconical spiraled boot having a circular upper perimeter and an obround lower perimeter. The lower perimeter is disposed upon the top surface of the base medially between each of the front side, the rear side, the left side, and the right side. An annular upper lip is disposed upon the upper perimeter at an angle relative the base. The upper lip includes an angular rim. The boot and the upper lip define a spiral inner recess, and the upper lip defines a spiral conduit. The angular rim assists precipitation to bead off of the upper lip. Any precipitation accumulated upon the angular rim will be allowed to roll off of the angular due to the effects of gravity. Any precipitation upon the upper lip that is in contact with the beading precipitation of the angular rim will be pulled by the downwardly beading precipitation of the angular rim due to the affect of van der Waals forces.

The conduit of the upper lip may vary in size to accommodate differently sized pipes. Additionally, the device could function without upper lip by designing the upper perimeter to define the conduit and conform to roof piping. However, the upper lip has the added purpose of stabilizing the pipe within the boot. Additionally, the upper lip contributes to decreased manufacturing costs by improving the adaptability of a single manufacturing mold of the device to fit variously shaped pipe sizes. Because different sized pipes will require different sized conduits, a single device can be adapted to accommodate any sized pipe merely by changing the size of the conduit of the upper lip. One envisioned way to achieve this is by cutting the conduit larger or smaller within the upper lip. Without the upper lip, the entire boot would have to be cut and reformed during manufacturing as a modification of the boot and the upper perimeter could adversely affect the spiraled design, decreasing flush fit of the device with a roof and roof pipe.

The base, the boot, and the upper lip have a shared continuous inner edge and a shared continuous outer edge. The inner edge includes an inner base edge portion, an inner boot edge portion, and an inner lip edge portion. The inner boot edge portion is angularly disposed between the inner base edge portion and the inner lip edge portion. The inner base edge portion extends from the right side toward the inner boot edge portion in a position parallel to the rear side. The inner boot edge portion and the inner lip edge portion are disposed within the inner recess. The outer edge has an outer base edge portion, an outer boot edge portion, and an outer lip edge portion. The outer boot edge portion is disposed between the outer base edge portion and the outer lip edge portion. The outer base edge portion extends from the left side toward the outer boot edge portion in a position parallel to the rear side.

A length of the outer boot edge portion is longer than a length of the inner boot edge portion. The angle of the upper lip relative the base is determined by the difference in length between the outer boot edge portion and the inner boot edge portion. Additionally, the boot is angled upon the base, such that the base will fit flushly upon a user's roof, while the boot will be directed vertically with the pipe of the roof. This allows for more aesthetically symmetrical appeal and flush contact between the device and each of the roof and the roof piping. A portion of the boot proximal and corresponding to the outer boot edge portion is longer in length than a portion of the boot proximal and corresponding to the inner boot edge portion. This contributes to the angle of the boot relative the base. Additionally the obround shape of the lower perimeter stabilizes the angle of the boot upon the base, although other shapes for the lower perimeter are envisioned that do not deviate from the spirit and scope of the invention.

The base, the boot, and the upper lip have a shared continuous exterior surface and a shared continuous interior surface. The exterior surface and the interior surface overlap each other at a contact surface. The contact surface includes flush junction of approximately one third of a surface area of the exterior surface with approximately one third of a surface area of the interior surface. The greater the overlap at the contact surface, the more water tight the device is in operation. The greater the contact surface, the less water will be able to penetrate the spiraled design. Thus, while preferred embodiments include flush junction of approximately one third of a surface area of the exterior surface with approximately one third of a surface area of the interior surface, other amounts of overlap are envisioned without deviating from the spirit and scope of the invention, however the amount of overlap must provide sufficient contact so as to render the device water proof.

The base, the boot, and the upper lip are monolithically molded from an elastomeric hydrophobic polymer substance. The substance provides the device a certain degree of flex. Thus, the base, the boot, and the upper lip are configured to flex from a closed spiral configuration, as seen in FIG. 1, to an open spiral configuration, as seen in FIG. 4. This allows the device to be fitted onto the device without having to first remove any impediments that may be attached to a bottom end of the pipe, such as electrical wires or antennas, which would otherwise impede fitting the device over the bottom end of the pipe. In practice, a user would flex the device into an open spiral configuration creating a gap between the exterior surface and the interior surface proximal the outer edge. The pipe is fitted between the gap to create an access to the now open conduit. The pipe is positioned within the open conduit. The user releases the flex upon the device and the device conforms back to its original spiraled design, fitting the pipe within the conduit, allowing the exterior surface and the interior surface to overlap creating the water tight and flush contact.

While the device comprises the aforementioned elements, it is also envisioned that this device could consist solely of a select grouping of these elements. One of the novelties of this device is that it eliminates the need for other components. For instance, some prior art may have an inner edge and an outer edge, but will rely on a removable or hinged wall component secured between these two edges, or will caulk the two edges with a sealant. The current spiral design roof pipe flashing accomplishes the function of flashing roof pipe in a monolithic device having a watertight overlap of the exterior surface with the interior surface forming the contact surface, thus, eliminating the need for additional components or caulk sealants.

Thus has been broadly outlined the more important features of the present monolithic spiral design roof pipe flashing so that the detailed description thereof that follows may be better understood and in order that the present contribution to the art may be better appreciated.

Numerous objects, features and advantages of the present monolithic spiral design roof pipe flashing will be readily apparent to those of ordinary skill in the art upon reading the following detailed description of presently preferred, but nonetheless illustrative, examples of the present monolithic spiral design roof pipe flashing when taken in conjunction with the accompanying drawings.

BRIEF DESCRIPTION OF THE DRAWINGS

Figures

DETAILED DESCRIPTION OF THE DRAWINGS

Figure 1:
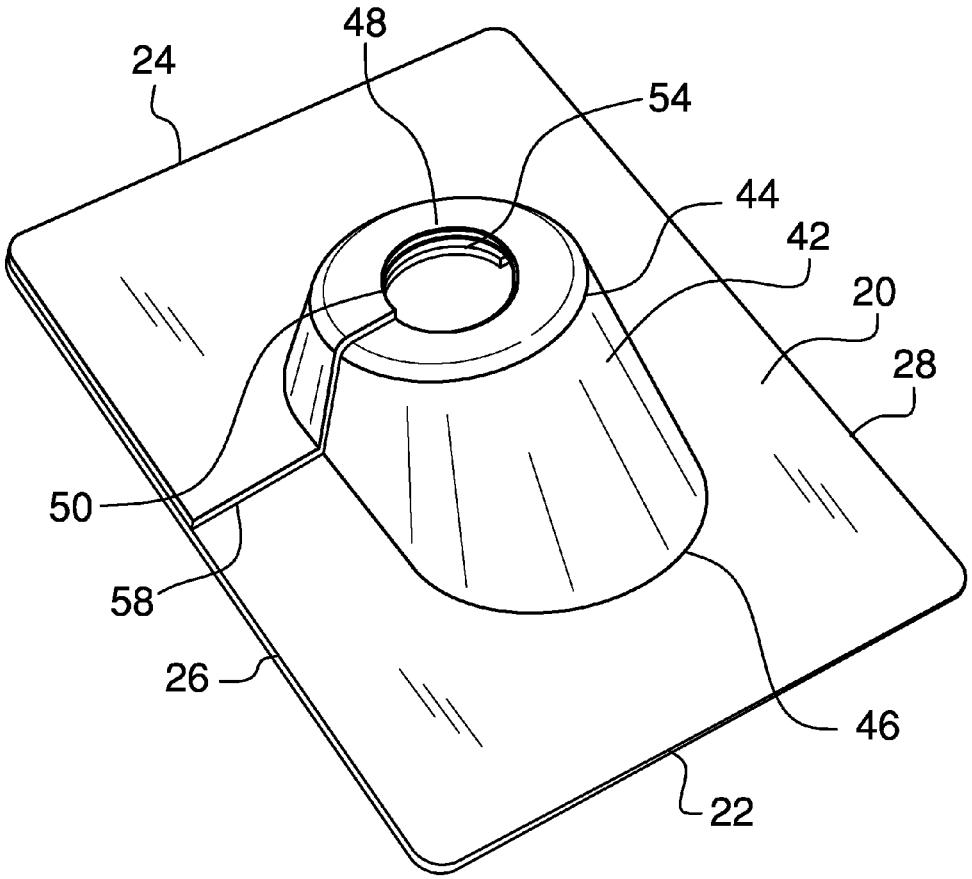
FIG. 1 is an isometric top view.
Figure 2:
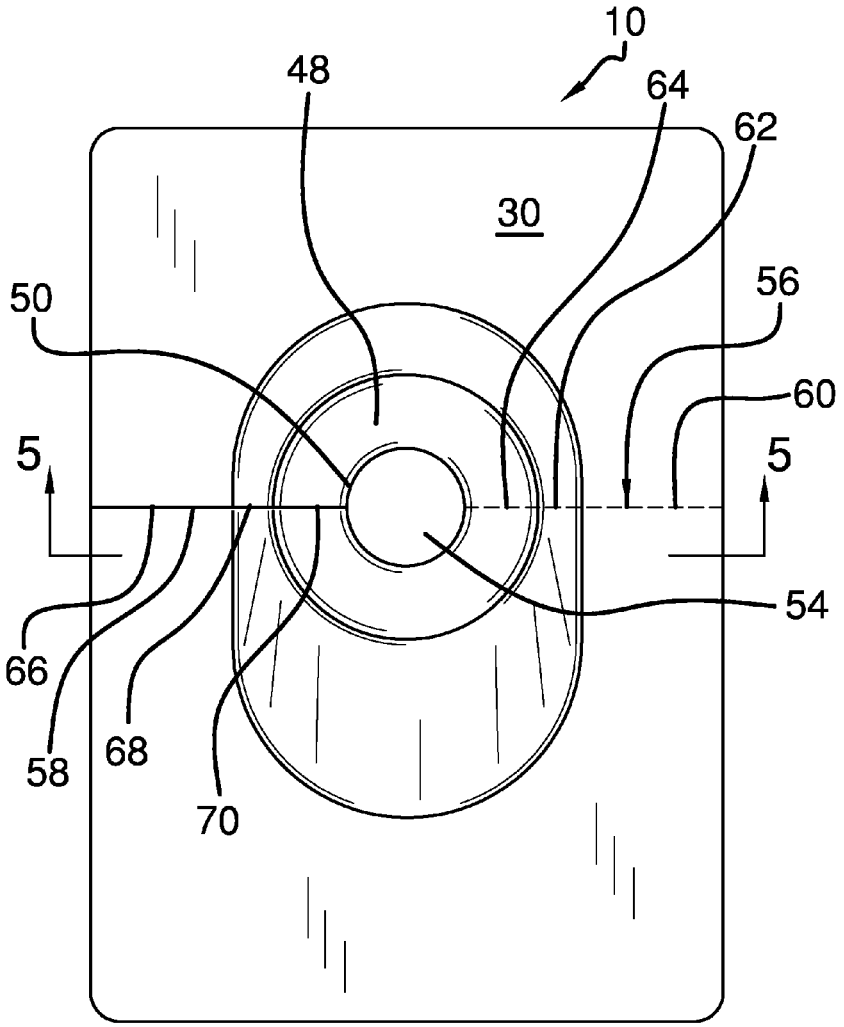
FIG. 2 is a top view.
Figure 3:
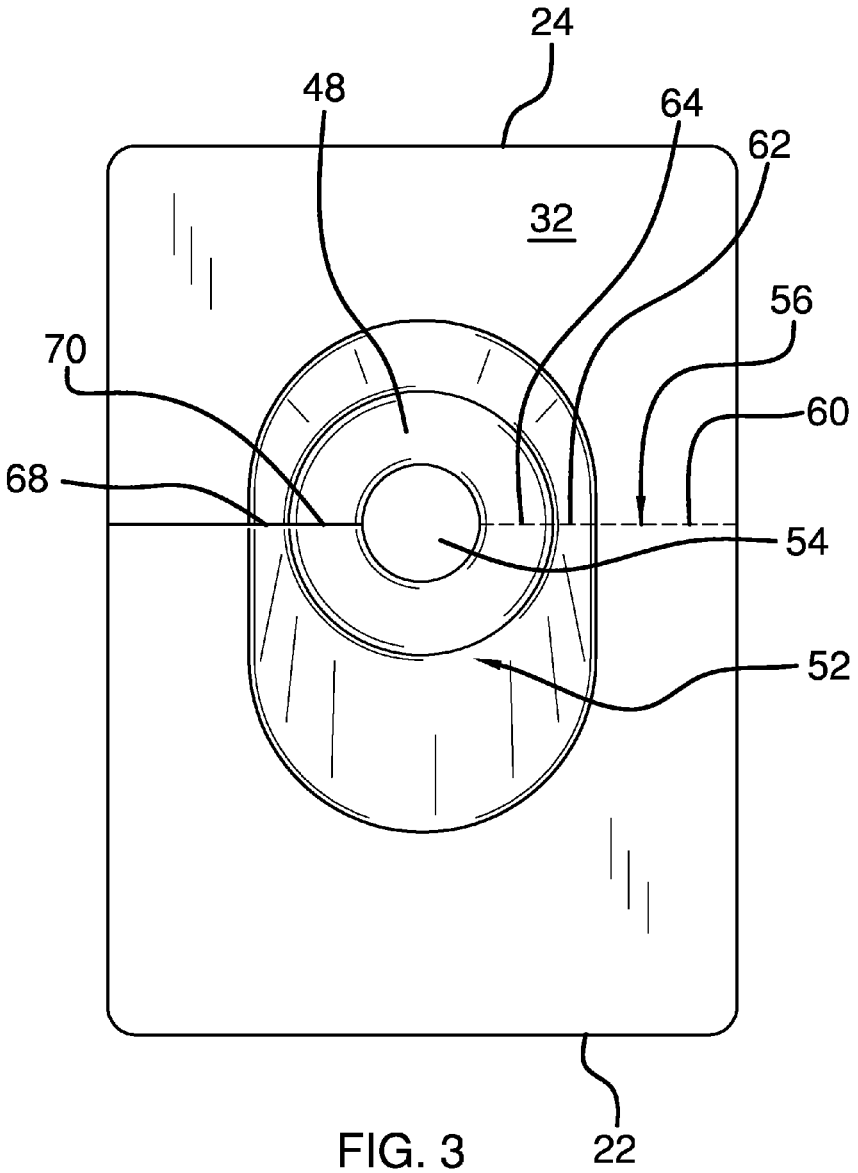
FIG. 3 is a bottom view.

With reference now to the drawings, and in particular FIGS. 1 through 6 thereof, the instant monolithic spiral design roof pipe flashing employing the principles and concepts of the present monolithic spiral design roof pipe flashing and generally designated by the reference number 10 will be described.

Referring to FIGS. 1 through 6 a preferred embodiment of the present monolithic spiral design roof pipe flashing 10, also referred to as the device 10, is illustrated. The monolithic spiral design roof pipe flashing 10 includes a spiraled base 20 having a front side 22 spaced apart from a rear side 24, a left side 26 spaced apart from a right side 28, a top surface 30, and a bottom surface 32. The device 10 further includes a frustoconical spiraled boot 42 having a circular upper perimeter 44 and an obround lower perimeter 46. The lower perimeter 46 is disposed upon the top surface 30 of the base 20 medially between each of the front side 22, the rear side 24, the left side 26, and the right side 28. An annular upper lip 48 is disposed along the upper perimeter 44 at an angle relative the base 20. The upper lip 48 includes an angular rim 50. The boot 42 and the upper lip 48 define a spiral inner recess 52. The upper lip 48 defines a spiral conduit 54.

The base 20, the boot 42, and the upper lip 48 have a shared continuous inner edge 56 and a shared continuous outer edge 58. The inner edge 56 includes an inner base edge portion 60, an inner boot edge portion 62, and an inner lip edge portion 64. The inner boot edge portion 62 is angularly disposed between the inner base edge portion 60 and the inner lip edge portion 64. The inner base edge portion 60 extends from the right side 28 towards the inner boot edge portion 62 in a position parallel to the rear side 24. The inner boot edge portion 62 and the inner lip edge portion 64 are disposed within the inner recess 52. The outer edge 58 has an outer base edge portion 66, an outer boot edge portion 68, and an outer lip edge portion 70. The outer boot edge portion 68 is disposed between the outer base edge portion 66 and the outer lip edge portion 70. The outer base edge portion 66 extends from the left side 26 towards the outer boot edge portion 68 in a position parallel to the rear side 28.

A length of the outer boot edge portion 68 is longer than a length of the inner boot edge portion 62. The angle of the upper lip 48 relative the base 20 is determined by the difference in length between the outer boot edge portion 68 and the inner boot edge portion 62.

The base 20, the boot 42, and the upper lip 48 have a shared continuous exterior surface 72 and a shared continuous interior surface 74. The exterior surface 72 and the interior surface 74 overlap each other at a contact surface 76. The contact surface 76 includes flush junction of approximately one third of a surface area of the exterior surface 72 with approximately one third of a surface area of the interior surface 74.

Figure 4:
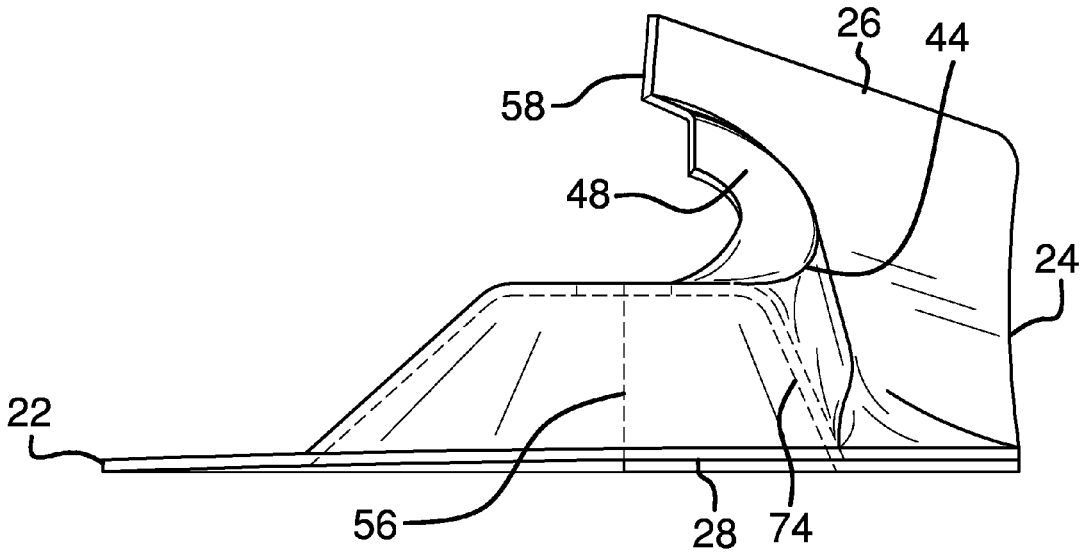
FIG. 4 is a side view in a partially-open spiral configuration.
Figure 5:
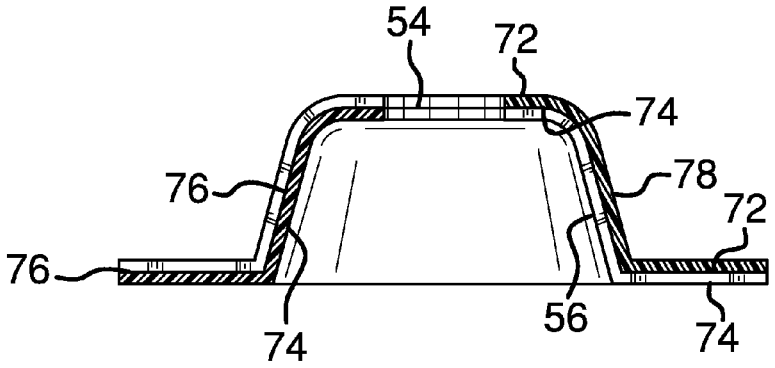
FIG. 5 is a cross-sectional view.
Figure 6:
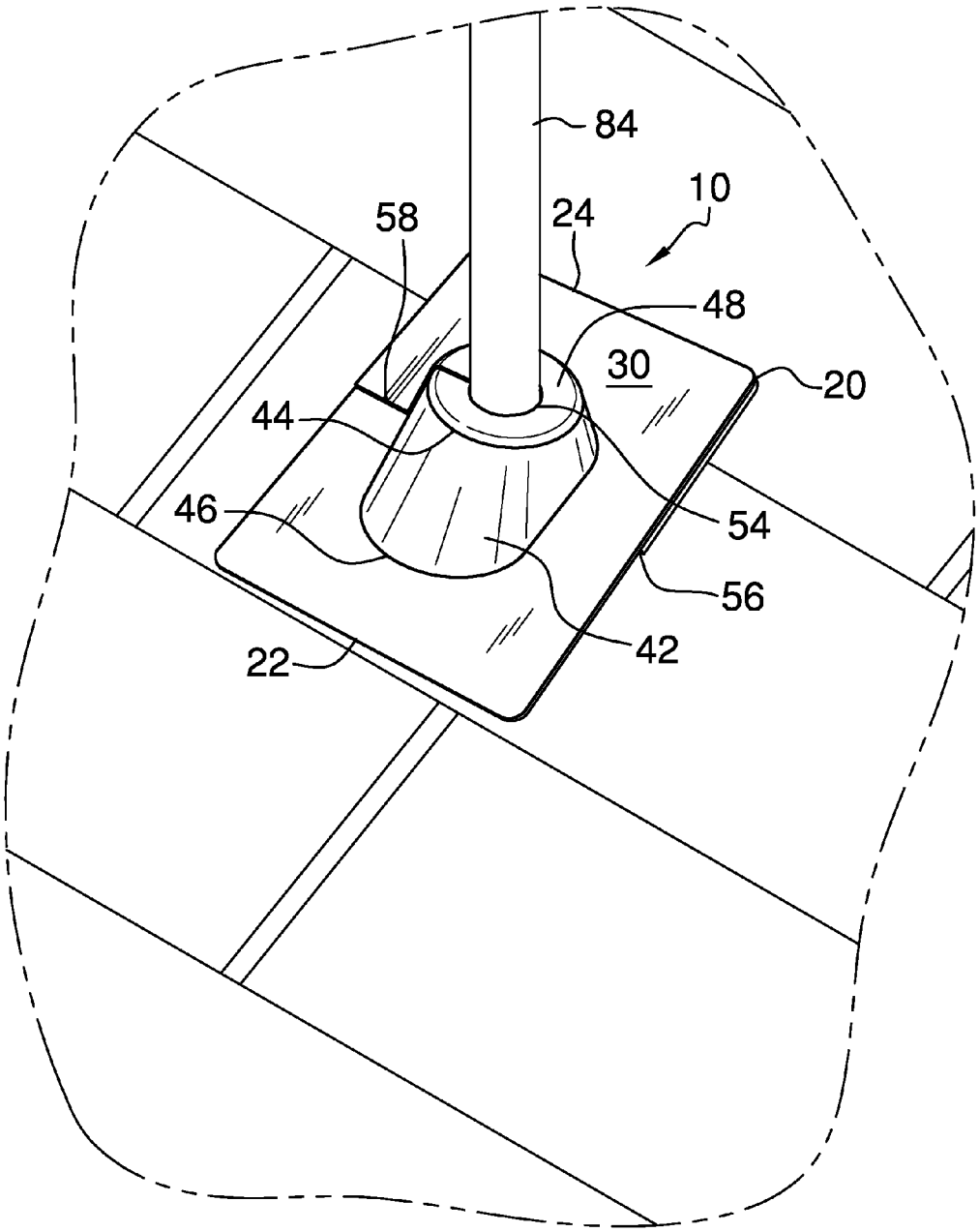
FIG. 6 is an in-use view.

The device 10 is monolithically molded from an elastomeric hydrophobic polymer substance 78. The substance 78 provides the device 10 a certain degree of flex. Thus, the base, the boot, and the upper lip are configured to flex from a closed spiral configuration, as seen in FIG. 1, to an open spiral configuration, as seen in FIG. 4. The open spiral configuration allows an access to the conduit 54, wherein the device 10 may be fitted onto a pipe 84 simply by flexing the exterior surface 72 away from the interior surface 74 and passing the pipe 84 through a gap that is created by the flexing. This allows the device 10 to be fitted onto the device 10 without having to first remove any impediments that may be attached to a bottom end of the pipe 84, such as electrical wires or antennas, which would otherwise impede fitting the device over the bottom end of the pipe 84.

While the device 10 comprises the aforementioned elements, it is also envisioned that this device could consist solely of a select grouping of these elements. One of the novelties of this device is that it eliminates the need for other components. For instance, some prior art may have an inner edge and an outer edge, but will rely on a removable or hinged wall component secured between these two edges, or will caulk the two edges with a sealant. The current spiral design roof pipe flashing 10 accomplishes the function of flashing roof pipe in a monolithic device 10 having a watertight overlap of the exterior surface 72 with the interior surface 74 forming the contact surface 76, thus, eliminating the need for additional components or caulk sealants.

What is claimed is:

1. A monolithic spiral design roof pipe flashing, consisting of:

a spiraled base having a top surface and a bottom surface;

a spiraled boot having an upper perimeter and a lower perimeter; the lower perimeter of the spiraled boot disposed upon the top surface of the base;

an annular upper lip disposed upon the upper perimeter of the spiraled boot at an angle relative the base, the upper lip having a raised angular rim, wherein each of the boot and the upper lip define a spiral inner recess, and wherein the upper lip defines a spiral conduit;

wherein the base, the boot, and the upper lip have a shared continuous inner edge and a shared continuous outer edge, the inner edge having an inner base edge portion, an inner boot edge portion, and an inner lip edge portion, the inner boot edge portion angularly disposed between the inner base edge portion and the inner lip edge portion, the inner boot edge portion and the inner lip edge portion disposed within the inner recess, the outer edge having an outer base edge portion, an outer boot edge portion, and an outer lip edge portion, the outer boot edge portion disposed between the outer base edge portion and the outer lip edge portion;

wherein the outer boot edge portion has a length different from a length of the inner boot edge portion, the angle of the upper lip being determined by a difference in length between the outer boot edge portion and the inner boot edge portion;

wherein the base, the boot, and the upper lip further have a shared continuous exterior surface and a shared continuous interior surface, the shared continuous exterior surface and the shared continuous interior surface overlapping at a contact surface; and wherein the base, the boot, and the upper lip are monolithically molded from a single elastomeric hydrophobic polymer substance, the base, the boot, and the upper lip configured to flex from a closed spiral configuration to an open spiral configuration.

2. The monolithic spiral design roof pipe flashing of claim 1 wherein the spiraled boot is frustoconical.

3. The monolithic spiral design roof pipe flashing of claim 1 wherein the upper perimeter of the spiraled boot is circular, and wherein the lower perimeter of the spiraled boot is obround.

4. The monolithic spiral design roof pipe flashing of claim 1 wherein the contact surface includes approximately one third of the shared continuous exterior surface and one third of the shared continuous interior surface, respectively.

* * * * *